US011420170B2

(12) United States Patent
Pisacane et al.

(10) Patent No.: US 11,420,170 B2
(45) Date of Patent: Aug. 23, 2022

(54) CLEANROOM CLEANING APPARATUS

(71) Applicant: Foamtec International Co., Ltd., Waco, TX (US)

(72) Inventors: Ferdinand Frederick Pisacane, San Diego, CA (US); Thng Cheok Long, Singapore (SG); Michael Edward Strauss, Tamarac, FL (US)

(73) Assignee: Foamtec International Co., Ltd., Waco, TX (US)

( * ) Notice: Subject to any disclaimer, the term of this patent is extended or adjusted under 35 U.S.C. 154(b) by 236 days.

(21) Appl. No.: 16/416,440

(22) Filed: May 20, 2019

(65) Prior Publication Data

US 2019/0270059 A1 Sep. 5, 2019

Related U.S. Application Data

(63) Continuation of application No. 13/212,276, filed on Aug. 18, 2011, now abandoned.

(60) Provisional application No. 61/452,811, filed on Mar. 15, 2011, provisional application No. 61/375,258, filed on Aug. 20, 2010.

(51) Int. Cl.

| | |
|---|---|
| ***B01F 35/71*** | (2022.01) |
| ***B08B 1/00*** | (2006.01) |
| ***C11D 3/48*** | (2006.01) |
| ***C11D 7/26*** | (2006.01) |
| ***C11D 17/04*** | (2006.01) |

(52) U.S. Cl.

CPC ..... *B01F 35/7139* (2022.01); *B08B 1/003* (2013.01); *B08B 1/006* (2013.01); *C11D 3/48* (2013.01); *C11D 7/261* (2013.01); *C11D 17/04* (2013.01)

(58) Field of Classification Search

CPC .. B01F 15/0215; B01F 35/7139; B08B 1/003; B08B 1/006; B08B 1/00; B08B 11/00; C11D 3/48; C11D 7/261; C11D 17/04

USPC ..... 206/459.5, 205, 207; 15/104.92

See application file for complete search history.

(56) References Cited

U.S. PATENT DOCUMENTS

| | | | | |
|---|---|---|---|---|
| 3,343,664 A | | 9/1967 | Poitras | |
| 3,472,415 A | * | 10/1969 | Woodruff ..... | B65D 17/521 220/277 |
| 3,635,567 A | | 1/1972 | Richardson, Jr. | |
| 3,889,804 A | | 6/1975 | Ravich | |

(Continued)

FOREIGN PATENT DOCUMENTS

| | | |
|---|---|---|
| CN | 1183062 A | 5/1998 |
| CN | 1448318 A | 10/2003 |

*Primary Examiner* — J. Gregory Pickett
*Assistant Examiner* — Jenine Pagan
(74) *Attorney, Agent, or Firm* — Zeman-Mullen & Ford, LLP

(57) ABSTRACT

A cleanroom cleaning device includes a multi-compartment container having two or more compartments and one or more breakable seals with at least one compartment containing a cleaning implement and at least another compartment containing a liquid capable of saturating the cleaning implement when the seals are broken. Another cleanroom cleaning device includes a nonbreakable/nonburstable outer pouch, a breakable/burstable inner pouch containing a liquid, and a cleaning implement where the inner pouch containing liquid and the cleaning implement are both contained within the outer pouch.

17 Claims, 6 Drawing Sheets

(56) References Cited

U.S. PATENT DOCUMENTS

| | | | | |
|---|---|---|---|---|
| 4,998,671 | A | 3/1991 | Leifheit | |
| 5,058,738 | A | 10/1991 | Svensson | |
| 5,688,394 | A * | 11/1997 | McBride, Jr. ..... | B65D 83/0805 134/40 |
| 5,702,035 | A | 12/1997 | Tsao | |
| 5,802,655 | A | 9/1998 | Denton | |
| 5,988,371 | A | 11/1999 | Paley et al. | |
| 6,062,381 | A | 5/2000 | Paley et al. | |
| 6,066,294 | A | 5/2000 | Lin et al. | |
| 6,068,820 | A | 5/2000 | De Guzman | |
| 6,786,329 | B2 | 9/2004 | Onishi | |
| 6,827,080 | B2 | 12/2004 | Fish et al. | |
| 6,945,402 | B1 | 9/2005 | Gueret | |
| 6,978,889 | B2 | 12/2005 | McBride | |
| 7,776,163 | B2 | 8/2010 | Xu et al. | |
| 8,038,000 | B2 | 10/2011 | Bonnell et al. | |
| 2002/0189966 | A1 | 12/2002 | Bergman | |
| 2003/0031764 | A1 | 2/2003 | Richards et al. | |
| 2004/0124101 | A1 | 7/2004 | Mitchell et al. | |
| 2005/0029138 | A1 | 2/2005 | Tsaur | |
| 2005/0155991 | A1 | 7/2005 | Jackman | |
| 2005/0245424 | A1 | 11/2005 | Patel et al. | |
| 2009/0078595 | A1 | 3/2009 | McKinley et al. | |
| 2011/0048977 | A1 | 3/2011 | Davidson et al. | |

* cited by examiner

CLEANROOM CLEANING APPARATUS

CROSS-REFERENCE TO RELATED APPLICATIONS

This application is a continuation of and claims the benefit of, and priority to U.S. Nonprovisional patent application Ser. No. 13/212,276 filed Aug. 18, 2011, currently pending, which claims priority to provisional patent application having Ser. No. 61/375,258 filed Aug. 20, 2010 and provisional patent application having Ser. No. 61/452,811 filed Mar. 15, 2011 which are all herein incorporated by reference in their entireties.

FIELD OF THE INVENTION

The present invention is directed to a cleanroom cleaning device which includes a multi-compartment container having one or more breakable seals. At least one compartment contains a cleaning implement for use in cleaning cleanrooms and at least one other compartment contains a liquid such that the liquid is capable of wetting or saturating the cleaning implement upon breaking the breakable seal positioned between the two compartments. The multi-compartment container has two or more compartments and a breakable seal located between each compartment. The invention is also directed to a cleanroom cleaning device which includes a nonbreakable/nonburstable outer pouch, a breakable/burstable inner pouch containing a liquid, and a cleaning implement where the inner pouch and the cleaning implement are contained within the outer pouch.

BACKGROUND OF THE INVENTION

A variety of cleanroom cleaning products are used to clean cleanroom facilities prior to and during ongoing fabrication taking place in the cleanrooms. The cleaning products, such as mops, hardware (e.g. mop buckets, wringers, handles, extensions and squeegees), sponges, wipes, swabs, and cleaning chemicals and solutions, are specifically designed and constructed from appropriate materials so as not to generate additional contamination in the cleanroom.

Several different chemicals are used for various cleaning jobs inside the cleanroom. These chemicals are used in conjunction with cleaning implements to adequately clean everything in the cleanroom facility including, but not limited to, floors, walls, mats, curtains, counters, operator gloves, wheels on carts, inner protective bags that contain product supplies, cleaning production equipment, and products. Isopropyl alcohol (IPA) is predominantly used in cleanrooms for cleaning because it is very clean, it cleans effectively, and it evaporates quickly leaving a clean and dry surface. Other chemicals used for cleaning include low ionic detergents and cleaners that are biodegradable, have low levels of trace metals, and have high evaporation rates. The chemicals are typically filtered and packaged in quarts and gallons. Some chemicals are also available in spray bottles. The chemicals are then applied to cleaning implements inside the cleanroom prior to cleaning.

However, applying chemicals to cleaning implements inside the cleanrooms has several disadvantages. First, certain chemicals and disinfectants have recommended dilution ratios. When individual operators, as well as a number of different operators, are responsible for carrying out the proper dilution of chemicals, it increases the risk of error for achieving the proper concentration of disinfectant solution. Second, there is a risk of introducing contamination when utilizing operators to dilute the chemicals/disinfectants and apply them to the cleaning implements. Third, there is a safety risk in having to store containers of chemicals/disinfectants and in dispersing chemicals/disinfectants from containers inside the cleanroom.

Pre saturated wipers, namely wipers packaged in a solvent safe container in which a predetermined amount of solvent has already been added, are also available for use in cleaning cleanrooms. However, pre saturated wipers for cleanroom use also have disadvantages. Wipers stored dry ill always be cleaner than wipers stored in a liquid because the liquid will break down the fiber structure of the wipers. This degradation is most severe with liquids or solvents such as IPA, methanol, and disinfectants. In addition, disinfectants lose activity as they are diluted and pre saturated wipers contain already diluted disinfectants.

Accordingly, there is a need for an improved method and device for providing cleanroom cleaning implements and cleaning chemicals/solvents which results in increased efficacy and efficiency, and decreased contamination, with respect to existing products and methods.

SUMMARY OF THE INVENTION

The present invention is directed to a cleanroom cleaning device that includes a container having two or more compartments, a breakable seal located between each compartment such that the compartments are in communication with one another upon breaking open the breakable seal(s), at least one cleanroom cleaning implement contained within a first compartment, and at least one of a liquid disinfectant, a liquid cleaning solution, and water contained in a second compartment. The cleaning implement may include, but is not limited to, a mop, a sponge or sponges, a wiper or multiple wipers, and a swab or multiple swabs.

In one exemplary embodiment, the cleanroom cleaning device of the present invention includes a container having two compartments, a breakable seal located between the two compartments, at least one cleaning implement contained in one compartment, and a liquid disinfectant contained in the other compartment. The cleaning implement may include, but is not limited to, a mop, one or more sponges, one or more wipers, or one or more swabs. The cleaning implement may be comprised of one or more of the following materials: a non woven material, a woven microfiber material, a knitted polyester material, a polyester material, a foam material, or a combination of any of the foregoing. The liquid disinfectant may include, but is not limited to, any one of the following: 100% isopropyl alcohol (IPA), 70% IPA/30% deionized (DI) water, 70% IPA/30% USP water or water for injection, 7% IPA/93% DI water, 100% methanol, and 100% ethanol. The multi-compartment container is designed to allow the operator to wet the cleaning implement with the liquid disinfectant just prior to use. Accordingly, the cleanroom cleaning product of the present invention ensures proper dilution of the disinfectant, decreased contamination, and structural integrity of the cleaning implement.

In another exemplary embodiment, the cleanroom cleaning device of the present invention includes a container having three compartments, a breakable seal located between each of the three compartments, at least one cleaning implement contained in a first compartment, either USP water or water for injection contained in a second compartment, and a liquid disinfectant or liquid cleaning solution contained in a third compartment. The cleaning implement may include, but is not limited to, a mop, one or more sponges, one or more wipers, or one or more swabs. The cleaning implement may be comprised of one or more of the following materials: a non woven material, a woven microfiber material, a knitted polyester material, a polyester material, a foam material, or a combination of any of the foregoing. The liquid disinfectant or liquid cleaning solution may include, but is not limited to, any one of the following: bleach, phenolic disinfectants, hydrogen peroxide ($H_2O_2$), quaternary amine based disinfectants, and Spor KLENZ sterilant. The amount of water contained in the second compartment is precisely measured to ensure that the resulting dilution ratio, i.e. the dilution ratio upon mixing the water with the liquid disinfectant or liquid cleaning solution, is optimal for disinfectant activity.

In yet another exemplary embodiment, the cleanroom cleaning device of the present invention includes a nonbreakable and nonburstable outer pouch, at least one cleaning implement contained within the outer pouch, and at least one breakable or burstable inner pouch contained within the outer pouch. The inner pouch contains at least one liquid which may include one or more of a liquid disinfectant, a liquid cleaning solution, and water. In addition, the inner pouch comprises a material that is capable of bursting or being broken open when pressure is applied to the outer pouch thereby releasing the liquid in the inner pouch into the interior of the outer pouch to saturate the cleaning implement. One example of such a material is a material that comprises highly branched polymers.

The liquid disinfectant and liquid cleaning solution contained within any of the cleanroom device embodiments may comprise any of those examples set forth above which refer to the same. In addition, the cleaning implements which are included in the various embodiments of the cleanroom device may be configured for use in classified cleanrooms including, but not limited to, one or more of an ISO Class 4 cleanroom, and ISO Class 5 cleanroom, and an ISO Class 6 cleanroom.

All exemplary embodiments of the cleanroom cleaning device of the present invention enable "point of use" saturation of a cleanroom cleaning implement with a liquid disinfectant or liquid cleaning solution which enables 1) limiting or eliminating potential operator contamination, 2) increasing the accuracy of the proper concentration of disinfectant solution or cleaning solution, and 3) ensuring the structural integrity of the cleaning implement for cleaning and reduced contamination from the cleaning implement while cleaning.

DETAILED DESCRIPTION

The cleanroom cleaning device of the present invention generally includes a container having two or more compartments, a breakable seal located between each compartment such that the compartments are in communication with one another upon breaking open the breakable seal(s), at least one cleanroom cleaning implement contained within a first compartment, and at least one of a liquid disinfectant, a liquid cleaning solution, and water contained in a second compartment. In another embodiment, the cleanroom cleaning device of the present invention may include a container having three compartments separated by breakable seals where one compartment contains a cleanroom cleaning implement, another compartment contains USP water or water for injection, and the third compartment contains a liquid disinfectant or liquid cleaning solution.

Figure 1:
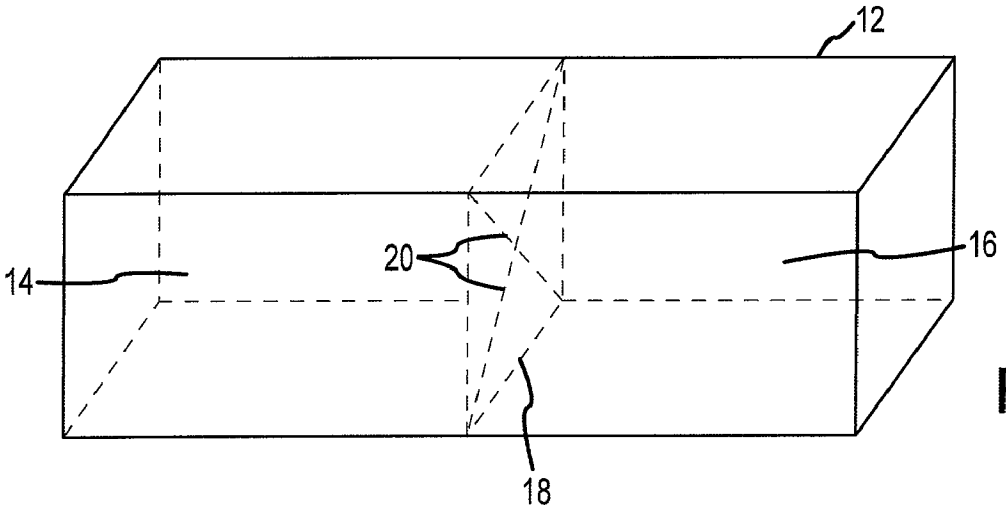
FIG. 1 is a perspective view of one exemplary embodiment of the multi-compartment container portion of the cleanroom cleaning device of the present invention with the interior of the container and an exemplary breakable seal between compartments shown in phantom.

FIG. 1 shows a perspective view of a multi-compartment container 12 portion of one exemplary embodiment of the cleanroom cleaning device of the present invention. Multi-compartment container 12 has a first compartment 14 and a second compartment 16 that are separated by a breakable seal 18 located between the first and second compartments 14,16. The breakable seal 18 comprises a liquid non-permeable material or membrane having tear lines 20. When pressure is applied to the liquid non-permeable membrane (such as, for example, by squeezing the container 12, twisting the container 12, or applying pressure to the container 12), the tear lines 20 open and cause the breakable seal 18 to open so that the contents of the first and second compartments 14,16 are in communication with one another. As a result, a liquid contained in one of the first or second compartments 14,16 can wet or saturate a cleaning implement contained in the other compartment.

Figure 2:
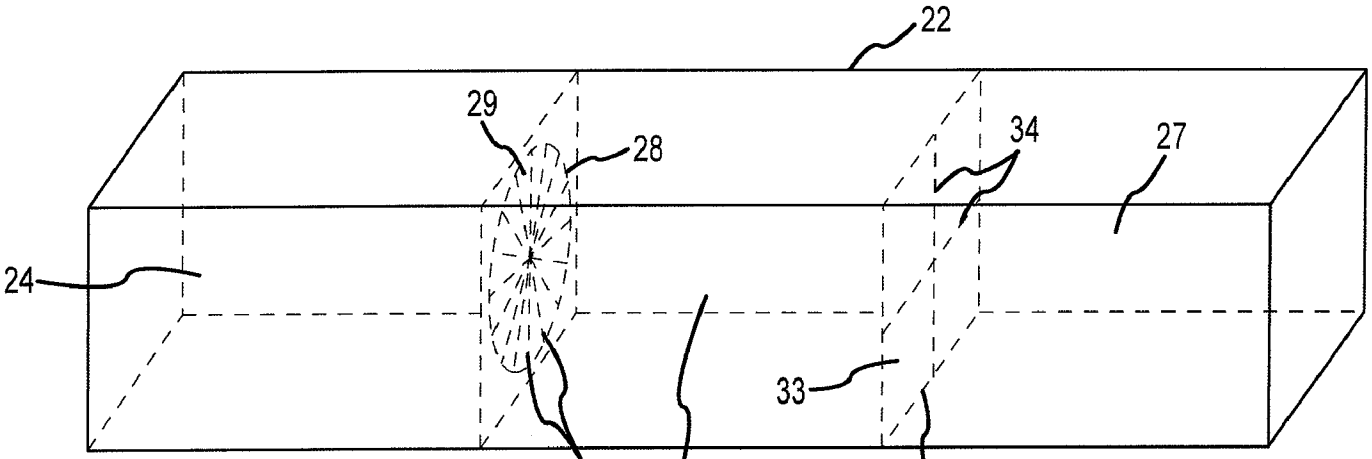
FIG. 2 is a perspective view of another exemplary embodiment of the multi-compartment container portion of the cleanroom cleaning device of the present invention with the interior of the container and additional exemplary embodiments of a breakable seal between compartments shown in phantom.

A perspective view of a multi-compartment container 22 portion of another exemplary embodiment of the cleanroom cleaning device of the present invention is shown in FIG. 2. Multi-compartment container 22 has a first compartment 24, a second compartment 26, and a third compartment 27 that are each separated form one another by breakable seals. Breakable seal 28 separating first compartment 24 and second compartment 26 comprises a liquid non-permeable material or membrane 29 having tear lines 30. When pressure is applied to the liquid non-permeable membrane 29, the tear lines 30 open and cause breakable seal 28 to open so that the contents of the first and second compartments 24,26 are in communication with one another. Likewise, breakable seal 32 separating second compartment 26 from third compartment 27 comprises a liquid non-permeable material or membrane 33 having tear lines 34. When pressure is applied to the liquid non-permeable membrane 33, the tear lines 34 open and cause breakable seal 32 to open so that the contents of the second and third compartments 26,27 are in communication with one another. In one exemplary embodiment, a liquid disinfectant or cleaning solution that needs to be diluted may be contained in the first compartment 24, water for diluting the liquid disinfectant or cleaning solution may be contained in the second compartment 26, and one or more cleaning implements may be contained in the third compartment 27.

Although the drawings show exemplary embodiments of the cleanroom cleaning device having a rectangular multi-compartment container, it should be understood that the multi-compartment container of the cleanroom cleaning device of the present invention may comprise any number of configurations and shapes and/or sizes including, but not limited to, a multi-compartment pouch type configuration comprised of a flexible non-permeable material. The multi-compartment container may be comprised of a liquid proof (i.e. liquid non-permeable), flexible plastic or polymer material that enables an operator to squeeze or twist the container, or apply pressure to the container, at one or more points to break the breakable seals that separate the compartments within the container.

The breakable seals may be comprised of a flexible non-permeable material or frangible membrane or the like that has tear lines which open upon pressure being applied to the non-permeable material or frangible membrane. This causes the breakable seal to open so that the contents of the separate compartments within the container are in communication with one another. Examples of these types of breakable seals are known in the prior art and are shown, for example, in U.S. Pat. Nos. 4,949,857, 4,789,082, 4,938,390, 5,636,772, and U.S. Patent Publication No. 2005/0155991.

Figure 3:
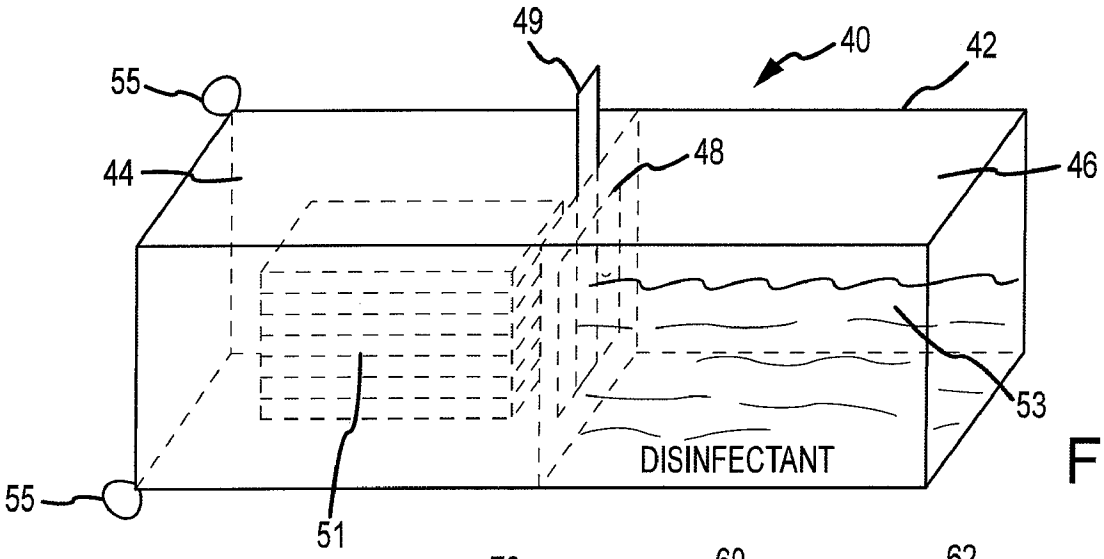
FIG. 3 is a perspective view of an exemplary embodiment of the cleanroom cleaning device of the present invention having a stack of wipers in one compartment and a liquid disinfectant solution in another compartment where the two compartments are separated by yet another embodiment of a breakable seal.

The breakable seals included in the cleanroom cleaning device of the present invention may also comprise seals that can be punctured, pulled open, broken, or opened via a valve structure, for example, so long as the structure of the multi-compartment container includes tructures or elements for breaking the seals in these manners. For example, FIG. 3 shows another exemplary embodiment of the cleanroom cleaning device 40 of the present invention which includes a multi-compartment container 42 having a first compartment 44 and a second compartment 46 that are separated by a breakable seal 48 with a pull tab 49 extending from the exterior surface of the container 42. Pulling this pull tab 49 results in peeling a portion of the breakable seal 48 away thereby creating an opening between the first and second compartments 44,46. For those multi-compartment containers where pressure or force on the container (e.g, squeezing or twisting the container) is not used to break the breakable seals contained within the container, the container may be comprised of any number of materials including non-flexible materials such as hard plastics and polymers provided that the materials are still non-permeable such that liquid cannot pass through them.

In the exemplary embodiment shown in FIG. 3, a plurality of wipers 51 are contained within the first compartment 44 of container 42 and a liquid disinfectant 53 is contained within the second compartment 46 of container 42. When pull tab 49 is pulled, a portion of breakable seal 48 is peeled away resulting in an opening through which the liquid disinfectant 53 can move from the first compartment 46 to second compartment 44 and saturate or wet the wipers 51.

In order to access the saturated wipers for cleaning, end tabs 55 that are coextensive with the material of the multi-compartment container may be included at either end of the container. These end tabs 55 are most likely best positioned and located at the end of the container nearest the compartment that contains the cleaning implement thereby enabling an operator or user to easily peel away a portion of the container by pulling on the end tabs 55 to expose and/or remove the saturated cleaning implement from the container.

Figure 4:
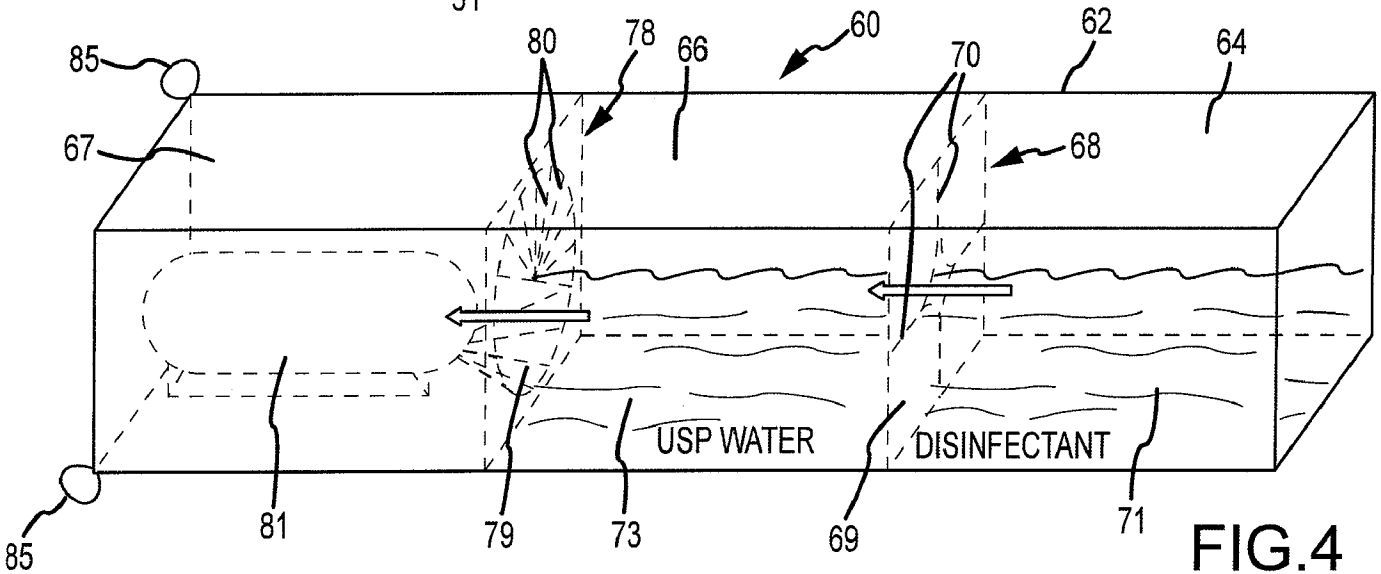
FIG. 4 is a perspective view of another exemplary embodiment of the cleanroom cleaning device of the present invention having three separate compartments separated by additional embodiments of a breakable seal with a cleanroom mophead contained in a first compartment, USP water or water for injection contained in a second compartment, and a liquid disinfectant or liquid cleaning solution contained in a third compartment.

FIG. 4 is a perspective view of yet another exemplary embodiment of the cleanroom cleaning device 60 of the present invention. Cleanroom cleaning device 60 includes a multi-compartment container 62 having a first compartment 64, a second compartment 66, and a third compartment 67 that are each separated from one another by breakable seals. Breakable seal 68 separating first compartment 64 from second compartment 66 comprises a liquid non-permeable membrane 69 having tear lines 70. When pressure is applied to liquid non-permeable membrane 69, the tear lines 70 open and cause breakable seal 68 to open so that liquid disinfectant 71 contained in first compartment 64 can flow into second compartment 66 which contains deionized water 73 for diluting the liquid disinfectant 71.

Similarly, breakable seal 78 separating second compartment 66 from third compartment 67 comprises a liquid non-permeable material or membrane 79 having tear lines 80. When pressure is applied to the liquid non-permeable membrane 79, the tear lines 80 open and cause breakable seal 78 to open so that the liquid disinfectant 71, now diluted with deionized water 73, can flow into the third compartment 67 to saturate mophead 81 contained in the third compartment 67. End tabs 85 are positioned and located at the end of the third compartment 67 of container 62 thereby enable an operator or user to easily peel away a portion of container 62 to expose and/or remove the saturated mophead 81 from container 62. Container 62 may be comprised of different materials where the end of container 62 attached to end tabs 85 is comprised of a flexible or malleable material that can be peeled away from the rest of the container 62 which may comprise another type of flexible or deformable material.

Figure 5:
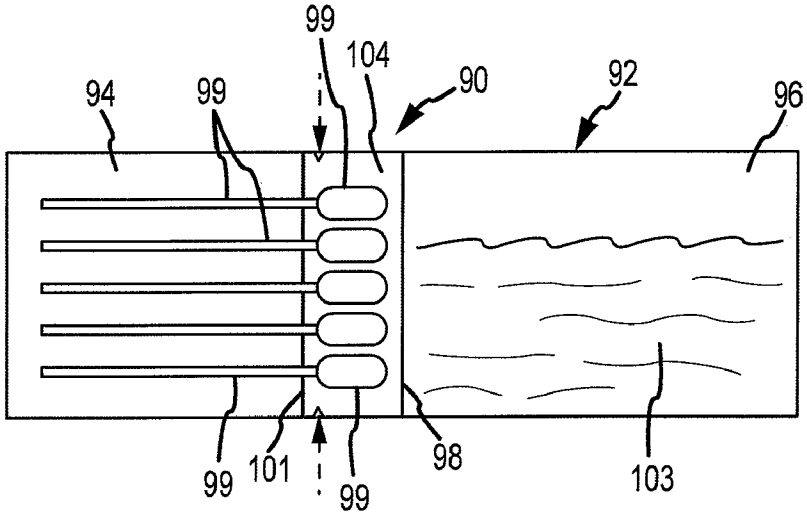
FIG. 5 is a cross-sectional view of yet another exemplary embodiment of the cleanroom cleaning device of the present invention having multiple swabs held in place by a non-permeable planar member in a first compartment and a liquid disinfectant solution in a second compartment where the two compartments are separated by a breakable seal that allows the liquid disinfectant from the first compartment to enter the second compartment and saturate the swabs extending above the non-permeable planar member. The container which includes the first and second compartments may also include an outer perforation and tear line positioned about the container that allows the second compartment containing the swabs to be completely separated from the first compartment containing the liquid disinfectant after the swabs are saturated with liquid disinfectant.

FIG. 5 is a cross-sectional view of yet another exemplary embodiment of the cleanroom cleaning device 90 of the present invention. Cleanroom cleaning device 90 includes a container 92 having a first compartment 94 and a second compartment 96 separated by a breakable seal 98. First compartment 94 contains multiple swabs 99 that are held in place within first compartment 94 by a non-permeable planar member 101, When breakable seal 98 is broken open, a liquid disinfectant 103 contained within the second compartment 96 flows into the area 104 of the first compartment 94 extending above (or to the right of) the non-permeable planar member 101 thereby saturating that portion of the swabs 99 extending above (or to the right of) the non-permeable planar member 101. Container 92 may be comprised of a material having an outer perforation and/or tear line (not shown) positioned about the container which allows the second compartment 96 containing the now saturated swabs 99 to be completely separated form the first compartment 94 containing the liquid disinfectant 103 after the swabs 99 are saturated with the disinfectant 103. A user may then easily remove the saturated swabs 99 one by one from the non-permeable planar member 101 contained within the first compartment 94 as needed for cleaning.

Figure 6:
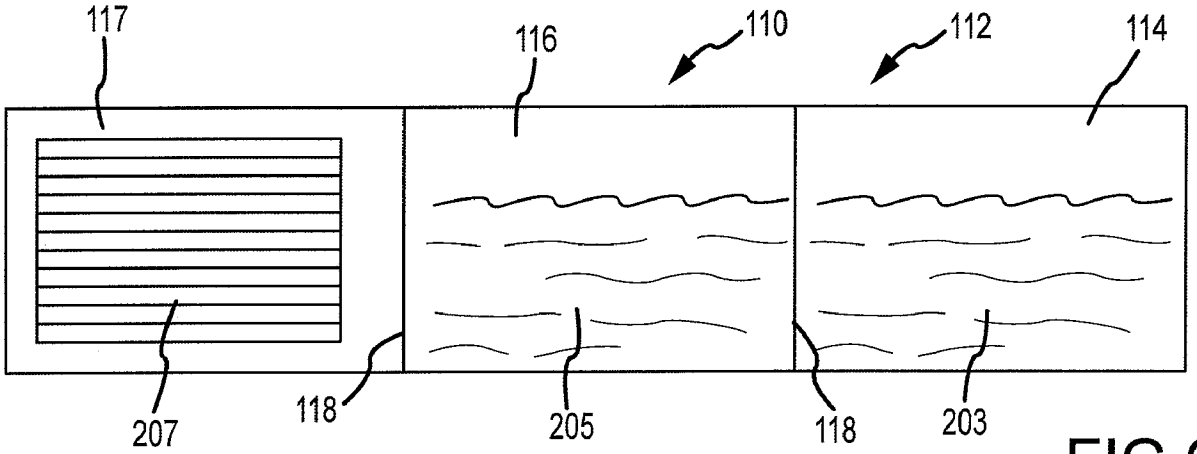
FIG. 6 is a cross-sectional view still another exemplary embodiment of the cleanroom cleaning device of the present invention having a first compartment containing multiple wipers, a second compartment containing USP water or water for injection, and a third compartment containing a liquid disinfectant or liquid cleaning solution. The compartments are separated by breakable seals.

A cross-sectional view still another exemplary embodiment of the cleanroom cleaning device 110 of the present invention is shown in FIG. 6. Cleanroom cleaning device 110 includes a container 112 having a first compartment 114, a second compartment 116, and a third compartment 117 where each of the compartments are separated by a breakable seal 118. The first compartment 114 contains a liquid disinfectant or liquid cleaning solution 203 which requires dilution, the second compartment contains deionized or injectable water 205, and the third compartment contains multiple wipers 207. When the breakable seals 118 are broken open, the liquid disinfectant or liquid cleaning solution 203 is mixed with the deionized or injectable water 205 with the resulting mixture then saturating the multiple wipers 207.

One advantage of the cleanroom cleaning device of the present invention is that it provides improved out of the bag cleanliness for cleanroom cleaning implements. For example, cleanroom wipers stored dry versus wipers stored in a liquid will always be cleaner and contain less contaminants because the liquid will break down the fiber structure of the wipers. This degradation is most severe with solvents such as IPA, methanol, and disinfectants. It is not uncommon for the cleanliness of dry wipers to be improved by 2 to 3 orders of magnitude over wet wipers.

FIGS. 7-10 show exemplary embodiments of the cleanroom cleaning device of the present invention that include a nonbreakable/nonburstable outer pouch 210 which contains both a plurality of wipers 211 and a breakable/burstable inner pouch 212. The outer pouch 210 is capable of holding both the wipers 211 (such as one or more stacks for wipers, for example) and the breakable/burstable inner pouch 212 that contains one or more liquids 213. The breakable/burstable inner pouch 212 can hold one or more different chemicals and/or solvents. The chemicals and/or solvents can include, but are not limited to, alcohols, disinfectants, cleaners, acetone, water, and other volatile liquids. This exemplary embodiment of the invention is multi-faceted. Certain chemicals, when introduced to substrates, will break the substrates down into base chemistries. This causes the release of fibers and particles that can cause contamination issues on sensitive surfaces. In addition, chemicals are difficult to hold in flexible packaging. The inner breakable/burstable inner pouch 212 of this exemplary embodiment of the cleanroom cleaning device 200 of the present invention is designed to hold chemicals for a maximum amount of time. The design of this exemplary embodiment of the cleanroom cleaning device 200 assures a much longer shelf life than other cleanroom cleaning devices. This exemplary embodiment of the cleanroom cleaning device 200 of the present invention is also more convenient and safe than other cleanroom cleaning devices. When utilizing this exemplary embodiment of the cleanroom cleaning device 200, an end user will not be directly subjected to the chemicals themselves but will instead only be subjected to the saturated wipers 211 upon their removal from the outer nonbreakable/nonburstable pouch 210. As a result, there is a decreased likelihood of liquid and/or chemical spills taking place and, even if spills were to occur, the volume of liquid and/or chemicals involved would constitute a much smaller volume than if an end user were using a bottle of liquid and/or chemicals to saturate the wipers.

Figure 7:
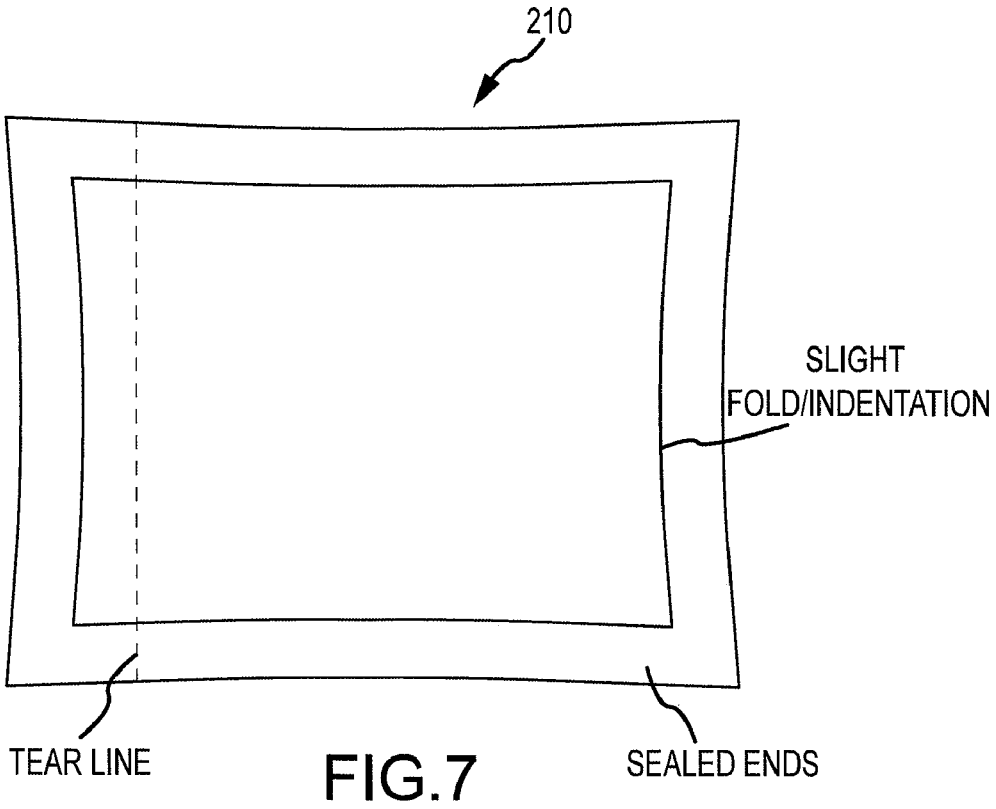
FIG. 7 is a top plan view of a nonbreakable/nonburstable outer pouch included in yet another exemplary embodiment of the cleanroom cleaning device of the present invention where a cleaning implement such as a mop, wiper, or swab, etc. and a breakable/burstable inner pouch containing a liquid are both contained within the nonbreakable/nonburstable pouch.
Figure 8:
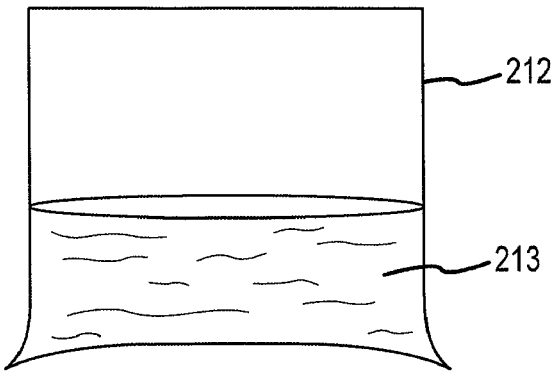
FIG. 8 is a perspective view of an exemplary embodiment of a breakable/burstable inner pouch containing a liquid that is located within the nonbreakable/nonburstable outer pouch shown in FIG. 7.

FIG. 7 shows a top plan view of a nonbreakable/nonburstable outer pouch 210 having sealed ends 220 and a perforation or tear line 222 for opening the outer pouch 210. In this exemplary embodiment of the cleanroom cleaning device 200, a cleaning implement and a breakable/burstable inner pouch containing a liquid are both contained within the outer pouch 210. FIG. 8 is a perspective view of an exemplary embodiment of a breakable/burstable inner pouch 212 having a liquid 213 contained therein.

Figure 9:
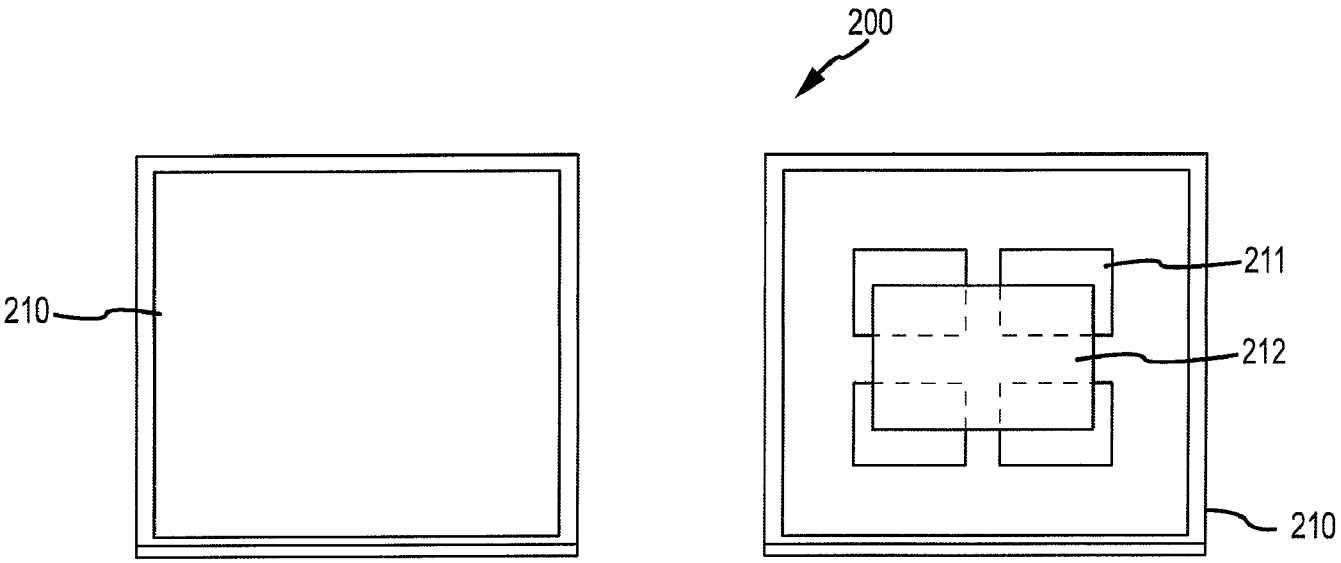
FIG. 9 is a schematic showing still another exemplary embodiment of the cleanroom cleaning device of the present invention which includes a nonbreakable/nonburstable outer pouch which contains both a plurality of wipers and a breakable/burstable inner pouch containing a liquid where the breakable/burstable inner pouch containing the liquid is placed on top of the plurality of wipers inside of the nonbreakable/nonburstable outer pouch.

FIG. 9 is a schematic showing still another exemplary embodiment of the cleanroom cleaning device 200 of the present invention which includes a nonbreakable/nonburstable outer pouch 210 which contains both a plurality of wipers 211 and a breakable/burstable pouch 212 containing a liquid 213 where the breakable/burstable inner pouch 212 containing the liquid 213 is placed on top of the plurality of wipers 211 inside of the nonbreakable/nonburstable outer pouch 210. As shown in FIG. 9 and as previously referred to in paragraph 0037 above, the plurality of wipers 211 may comprise one or more stacks of wipers. In addition, as shown in FIG. 9, the breakable/burstable inner pouch 212 is larger in dimension (in terms of length and width) than each of the individual wipers which make up the plurality of wipers 211 that are arranged in stacks. Also as shown in FIG. 9, breakable/burtstable inner pouch 212 is positioned such that it is located or positioned over only a portion of each of the wipers that make up the plurality of wipers 211 so that it extends beyond at least one edge of each of the wipers that make up the plurality of wipers 211. The exemplary embodiment of the cleanroom cleaning device 200 shown in FIG. 9 shows the plurality of wipers 211 arranged in two or more stacks (and in this case four stacks) within nonbreakable/nonburstable outer pouch 210 with breakable/burstable inner pouch 212 also contained within nonbreakable/nonburstable outer pouch 210 and positioned over the plurality of wipers 211. The breakable/burstable inner pouch 212 is larger in dimension (in terms of width and length) than each of the wipers that make up the plurality of wipers 211 and is positioned such that it is located or positioned over only a portion of each of the wipers that make up the plurality of wipers 211 so that it extends beyond at least one edge of each of the wipers that make up the plurality of wipers 211.

Another advantage of the cleanroom cleaning device of the present invention is the improved efficacy of the disinfectants that are used with the cleaning implements. Disinfectants lose activity as they are diluted. The three compartment container contained in one exemplary embodiment of the cleanroom cleaning device of the present invention enables the disinfectant to be kept separate from any diluents prior to actual use thereby ensuring disinfectant performance.

Figure 10:
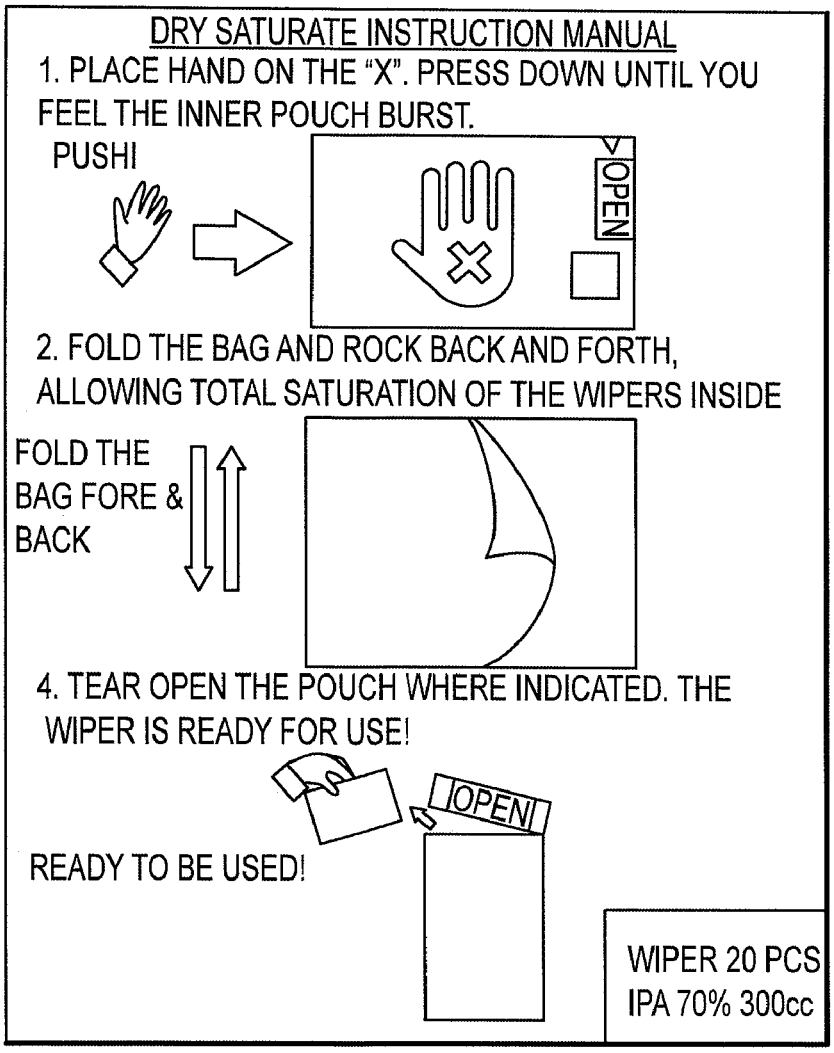
FIG. 10 is an exemplary embodiment of a label for placement on the outside of the cleanroom cleaning device of the present invention such as the cleanroon cleaning device of the present invention shown in FIGS. 7 and 9 which includes an exemplary set of instructions.

FIG. 10 is an exemplary embodiment of a label for placement on the outside of the cleanroom cleaning device of the present invention such as the cleanroon cleaning device 200 of the present invention shown in FIGS. 7 and 9 which includes an exemplary set of instructions for using the cleanroom cleaning device 200.

Still another advantage of the cleanroom cleaning device of the present invention is the increased accuracy in achieving the appropriate concentration of disinfectant solution while reducing the potential for contamination. The amounts of disinfectant solutions and additional diluents contained within the separate compartments of the multi-compartment container of the cleanroom cleaning device of the present invention ensure that the exact concentration of disinfectant or cleaning solution is achieved within a controlled environment (the multi-compartment container) without the need for external operator manipulation.

The cleanroom cleaning device of the present invention provides cleanroom users with the convenience, safety, and human factor advantages that are present with currently used pre-saturated cleaning implements without the problems of contamination and disinfectant inactivity that exist with current pre-saturated products and options.

Exemplary embodiments of the invention are described above in the Drawings and Description of Exemplary Embodiments. While these descriptions directly describe the above embodiments, it is understood that those skilled in the art may conceive modifications and/or variations to the specific embodiments shown and described herein. Any such modifications or variations that fall within the purview of this description are intended to be included therein as well, Unless specifically noted, it is the intention of the inventors that the words and phrases in the specification and claims be given the ordinary and accustomed meanings to those of ordinary skill in the applicable art(s). The foregoing description of exemplary embodiments and best mode of the invention known to the applicants at the time of filing the application has been presented and is intended for the purposes of illustration, and description. It is not intended to be exhaustive or to limit the invention to the precise form disclosed, and many modifications and variations are possible in the light of the above teachings. Exemplary embodiments were chosen and described in order to best explain the principles of the invention and its practical application and to enable others skilled in the art to best utilize the invention in various embodiments and with various modifications as are suited to the particular use contemplated.

What is claimed is:

1. A cleanroom cleaning device comprising:

a nonbreakable and nonburstable outer pouch;

a plurality of stacks of wipers contained within the outer pouch: and at least one breakable or burstable inner pouch contained within the outer pouch that is larger in length and width than each of an individual stack of wipers of the plurality of stacks of wipers where the at least one inner pouch contains at least one liquid and is positioned over only a portion of each of the individual stacks of wipers and extends beyond at least one edge of each of the individual stack of wipers to enable optimal saturation of the wipers for cleaning cleanroom facilities.

2. The cleanroom cleaning device of claim 1 wherein the at least one inner pouch comprises a material enabling the at least one pouch to burst or be broken open upon applying pressure to the outer pouch.

3. The cleanroom cleaning device of claim 1 wherein the plurality of stacks of wipers are configured for use in one or more of an ISO Class 4 cleanroom, an ISO Class 5 cleanroom, and an ISO Class 6 cleanroom.

4. The cleanroom cleaning device of claim 1 wherein the plurality of stacks of wipers are comprised of one or more of a non-woven material, a microfiber material, a knitted polyester material, and a foam material.

5. The cleanroom cleaning device of claim 1 wherein the at least one liquid comprises at least one of a liquid disinfectant, a liquid cleaning solution, and water.

6. The cleanroom cleaning device of claim 5 wherein the liquid disinfectant consists of at least one of a 100% isopropyl alcohol solution, a 70% isopropyl alcohol and 30% deionized water solution, a 70% isopropyl alcohol and 30% injectable water solution, a 70% isopropyl alcohol and 93% deionized water solution, a 100% methanol solution, or a 100% ethanol solution.

7. The cleanroom cleaning device of claim 5 wherein the liquid disinfectant and/or the liquid cleaning solution consists of at least one of a member selected from the group of a bleach, a phenolic disinfectant, a hydrogen peroxide, a quarternary amine based disinfectant, and a sterilant.

8. The cleanroom cleaning device of claim 1 wherein the plurality of stacks of wipers are arranged in four stacks within the outer pouch and the inner pouch is positioned over only a portion of each of the four stacks of wipers so that it also extends beyond at least one edge of each of the four stacks of wipers.

9. The cleanroom cleaning apparatus of claim 1 further comprising a designated hand position marking on the outer surface of the outer pouch for placing a user's hand.

10. A method for accessing the stacks of wipers of claim 1 comprising the steps of:

pressing a user's hand on a predesignated hand position contained on an outer surface of the outer pouch until the inner pouch bursts;

folding the outer pouch back and forth to allow for complete saturation of the stacks of wipers; and tearing the outer pouch open to access the saturated stacks of wipers.

11. A cleanroom cleaning device comprising: a nonbreakable and nonburstable outer pouch;

at least one cleaning implement contained within the outer pouch;

at least one breakable or burstable inner pouch contained within the outer pouch where the at least one inner pouch contains at least one liquid; and a designated hand position marking on the outer surface of the outer pouch for placing a user's hand wherein the designated hand position comprises an outline of a full hand with an X marking placed over a palm portion of the outline of the full hand.

12. The cleanroom cleaning device of claim 11 wherein the at least one inner pouch comprises a material enabling the at least one pouch to burst or be broken open upon applying pressure to the outer pouch.

13. The cleanroom cleaning device of claim 11 wherein the at least one cleaning implement is configured for use in one or more of an ISO Class 4 cleanroom, an ISO Class 5 cleanroom, and an ISO Class 6 cleanroom.

14. The cleanroom cleaning device of claim 11 wherein the at least one cleaning implement comprises at least one of a mophead, a sponge, a wiper, and a swab.

15. The cleanroom cleaning device of claim 14 wherein the at least one cleaning implement is comprised of one or more of a non-woven material, a microfiber material, a knitted polyester material, and a foam material.

16. The cleanroom cleaning device of claim 11 further comprising a label placed on the outer surface of the outer pouch wherein the label includes instructions for placing a user's hand on the X in the full hand outline contained on the outer surface of the outer pouch and instructions for folding the outer pouch back and forth before tearing the outer pouch open.

17. A method for accessing the at least one cleaning implement of claim 11 comprising the steps of:

pressing a user's hand on the predesignated hand position marking contained on the outer surface of the outer pouch until the inner pouch bursts;

folding the outer pouch back and forth to allow for complete saturation of the at least one cleaning implement; and tearing the outer pouch open to access the saturated at least one cleaning implement.

* * * * *